United States Patent [19]

Hart et al.

[11] Patent Number: 4,917,160

[45] Date of Patent: Apr. 17, 1990

[54] STORAGE BAG

[76] Inventors: Diana L. Hart, 6134 Windamar Rd.; Nancy A. Hames, 4335 Onondaga, both of Toledo, Ohio 43611

[21] Appl. No.: 321,392

[22] Filed: Mar. 10, 1989

[51] Int. Cl.[4] ..... A45C 3/00; A45C 1/04; A45C 13/10; A45C 15/00

[52] U.S. Cl. ..... 150/106; 150/112; 190/109; 374/141; 383/11; 383/13

[58] Field of Search ..... 297/194, DIG. 6; 224/901, 253; 374/141; 206/545; 150/106, 108, 112; 383/13, 16, 11; D3/48, 71, 74; 190/109, 110

[56] References Cited

U.S. PATENT DOCUMENTS

| | | | |
|---|---|---|---|
| D. 273,535 | 4/1984 | Weinreb | D3/71 X |
| 2,061,302 | 11/1936 | Egler | 297/194 |
| 3,042,467 | 7/1962 | Germick | 297/194 X |
| 3,157,303 | 11/1964 | Siegel | 383/16 X |
| 3,813,017 | 5/1974 | Pimsleur | 224/901 X |
| 3,909,092 | 9/1975 | Kiernan | 297/194 X |
| 4,003,598 | 1/1977 | Glaze | 297/194 |
| 4,024,997 | 5/1977 | Kolpin | 224/901 X |
| 4,240,480 | 12/1980 | Strobel | 383/13 X |
| 4,339,061 | 7/1982 | Dunn | 297/194 X |
| 4,548,375 | 10/1985 | Moss | 383/11 X |
| 4,676,416 | 6/1987 | Harmon | 224/901 X |
| 4,724,791 | 2/1988 | McSorley | 224/253 X |
| 4,728,147 | 3/1988 | Dutton | 297/DIG. 6 X |
| 4,730,869 | 3/1988 | Schumacher | 297/194 |

FOREIGN PATENT DOCUMENTS

| | | | |
|---|---|---|---|
| 771744 | 10/1934 | France | 383/16 |
| 1314020 | 4/1973 | United Kingdom | 206/545 |

*Primary Examiner*—Sue A. Weaver
*Attorney, Agent, or Firm*—Leon Gilden

[57] ABSTRACT

A storage bag is set forth for use particularly by sun bathers and the like providing a bag of flexible construction formed with a sun-glass eye case secured to a rear wall interiorly of the bag with a first securement flap oriented adjacent the sun-glass case for securement of liquid containers, such as suntanning lotion and the like therewithin. A second flexible securement flap is oriented in a first position overlying the first securement flap securable with a hook and loop fastener strip positioned coextensively with a remote edge of the first securement flap wherein the second securement flap is repositionable to a second position securable to a further hook and loop fastener strip formed on an interior surface of the forward wall to selectively compartmentalize the interior of the flexible storage bag. The flexible construction of the securement flaps enables the same to be compressed against the interior surface of the rear wall when not being utilized. A plurality of engagement straps are formed to an exterior surface of the rear wall for securement about supports to maintain the storage bag in a desired position relative to a lawn chair and the like. Further, a flexible temperature indicating strip is positioned adjacent an upper edge of the forward wall to indicate a temperature range for utilization by a sun bather in enabling an individual to determine a time length of a sun bathing event.

6 Claims, 1 Drawing Sheet

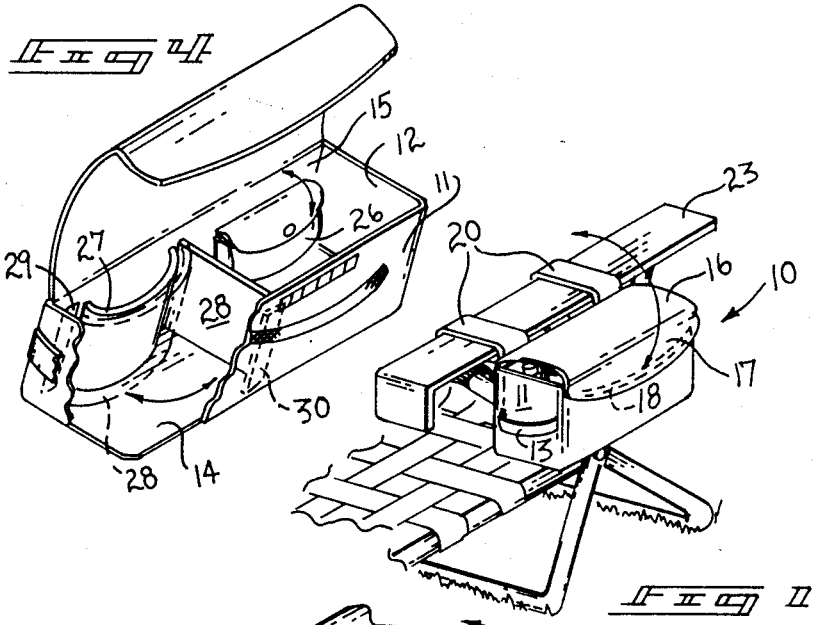
Fig 4
Fig 1
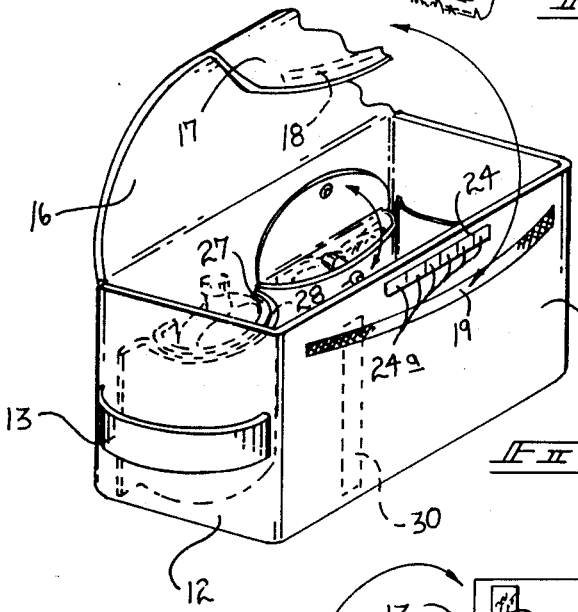
Fig 2
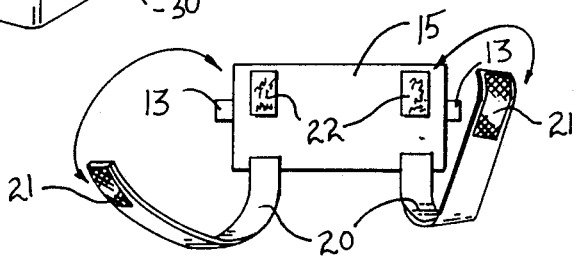
Fig 3

STORAGE BAG

BACKGROUND OF THE INVENTION

1. Field of the Invention

The field of invention relates to accessory bags, and more particularly pertains to a new and improved storage bag for utilization particularly by sun bathers which, when not being utilized, may be folded into a compact size for transport or storage of the same.

2. Description of the Prior Art

The use of storage bags of various types is well known in the prior art. As may be appreciated, these devices typically require a substantial amount of space and such is desirable to store the devices when they are not being utilized. In this connection, there have been several attempts to develop storage bags for utilization and application to particular events, but have heretofore not provided a flexible storage bag for use particularly by sun bathers, as set forth by the instant invention. For example, U.S. Pat. No. 3,909,092 to Kiernan sets forth a rigid molded one-piece console for use within an automotive environment formed with a series of compartments and the like for storage of various items therewithin. The Kiernan patent is of interest relative to the use of a storage container provided for a particular application, but of a relatively remote organization to that of the instant invention.

U.S. Pat. No. 4,339,061 to Dunn sets forth an accessory case of a generally rectangular configuration and of ostensibly rigid construction provided with a covering flap and hook and loop fastener straps for securement to a wheel chair with a rigid partition therebetween. The patent to Dunn is removed from that of the instant invention by the rigid construction of the partition and the case itself discouraging convenient and compact storage of the device. Further, the Dunn patent does not provide the teaching of compressible securement and partition-type flaps which may be easily displaced and compacted against the rear surface of the storage bag for providing increased use of the interior compartment when the use of such securement flaps is not desired.

U.S. Pat. No. 4,003,598 to Glaze sets forth the use of a chair mounted tray wherein the tray is of a relatively rigid construction and is of interest relative to the notion of securement of a support assembly relative to a chair arm.

U.S. Pat. No. 4,728,147 to Dutton sets forth a cup holder provided with a hook and loop fastener strap securable to a rigid clip for securement to a lawn chair. The device further sets forth the use of a tray-like rigid member in addition to the cup support when additional storage is desired. The rigid and limited use of the patent is of interest relative to the securement of the device to an arm chair, but is of a relatively remote organization to that of the instant invention.

U. S. Pat. No. 4,730,869 to Schumacher sets forth a storage compartment&of relatively rigid construction for securement to the arm of a wheel chair for storage of various small articles and the like therewithin.

As such, it may be appreciated that there is a continuing need for a new and improved storage bag which addresses both the problems of ease of use and compactness of storage wherein the instant invention substantially fulfills this need.

SUMMARY OF THE INVENTION

In view of the foregoing disadvantages inherent in the known types of storage bags now present in the prior art, the present invention provides a storage bag wherein the same may be compactly stored when not use and may be further easily and efficiently secured to a support arm of a lawn chair and provided with a selectively utilized compartment divider for use within the storage bag which may be flexibly and readily repositioned when not in use. As such, the general purpose of the present invention, which will be described subsequently in greater detail, is to provide a new and improved storage bag which has all the advantages of the prior art storage bags and none of the disadvantages.

To attain this, the present invention comprises a storage bag of flexible construction provided with a covering flap overlying a temperature indicator strip and further including engagement straps for securement of the storage bag to a support arm of a lawn chair for use by a sun bather. The storage bag further includes an elongate hook and loop fastener strip secured to an interior surface of a rear wall of the bag for securement and storage of a flexible partition and securement flap which may be positioned about an existing securement flap for storage of liquid containers and the like therewithin. The flexible securement and partition flap is repositionable to a second position spanning the distance between the rear and a forward wall of the storage bag for selective partitioning of the interior compartment of the bag. The flexible construction of the flaps enable displacement of the flaps for enhanced use of the interior of the storage bag when large components are stored therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved storage bag which has all the advantages of the prior art storage bags and none of the disadvantages.

It is another object of the present invention to provide a new and improved storage bag which may be easily and efficiently manufactured and marketed.

It is a further object of the present invention to provide a new and improved storage bag which is of a durable and reliable construction.

An even further object of the present invention is to provide a new and improved storage bag which is susceptible of a low cost of manufacture with regard to both materials and labor, and which accordingly is then susceptible of low prices of sale to the consuming public, thereby making such storage bag economically available to the buying public.

Still yet another object of the present invention is to provide a new and improved storage bag which provides in the apparatuses and methods of the prior art some of the advantages thereof, while simultaneously overcoming some of the disadvantages normally associated therewith.

Still another object of the present invention is to provide a new and improved storage bag wherein the same is of a flexible construction which may be readily and effectively compacted for storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention secured to an arm rest of a conventional lawn chair.

FIG. 2 is an isometric illustration of the instant invention illustrating the various components contained therewithin.

FIG. 3 is a rear orthographic view, taken in elevation, of the instant invention.

FIG. 4 is an isometric illustration, partially in section, of the storage bag of the instant invention.

DESCRIPTION OF THE PREFERRED EMBODIMENT

With reference now to the drawings, and in particular to FIGS. 1 to 4 thereof, a new and improved storage bag embodying the principles and concepts of the present invention and generally designated by the reference numeral 10 will be described.

More specifically, it will be noted that the storage bag apparatus 10 essentially comprises a rectangular compartment defined by a forward wall 11, spaced parallel side walls 12, a bottom wall 14, and a rear wall 15. The walls 11 through 15 are each formed utilizing flexible canvas-like or polymeric material providing durability to the organization.

A top covering wall 16 is hingedly secured to an upper edge of the rear wall 15 and includes a forwardly oriented downwardly depending flap 17 flexibly and pivotally secured to the covering wall 16. A first hook and loop fastening strip 18 is secured to an interior surface of the depending flap 17 to cooperate with a second hook and loop fastening strip 19 fixedly positioned and spaced below a top edge of the forward wall at an uppermost portion of an outer surface of the forward wall 11 enabling selective securement of the flap 17 to the forward wall. The side walls 12 include flexible handle straps 13 secured at each of their terminal ends to opposite sides of the opposed side walls 12. Secured adjacent the lowermost edge of the rear wall 15 are a plurality of spaced elongate engagement straps 20 provided with first hook and loop fastener patches 21 secured to exterior faces of the straps 20 adjacent forwardmost edges of the aforenoted straps. The patches 21 are selectively engageable with second hook and loop fastener patches 22 positioned parallel to one another on the rear face of the rear wall 15 aligned above the engagement straps 20. In this manner, the engagement straps 20 may be secured about an associated arm of a lawn chair, as illustrated in FIG. 1, to enable an individual engaged in a sun bathing event to conveniently and readily secure the storage bag 10 in a convenient location proximate the individual.

A flexible temperature indicating strip 24 is positioned on the forward wall 11 spaced between an upper edge of the forward wall 11 and the second hook and loop fastener strip to normally protect the flexible temperature indicating strip 24 from debris and the like and will expose the strip 24 and the temperature panels **24*a*** to an individual to enable the individual to more readily gauge the length of a sun bathing event by visual understanding of the ambient temperature to enable an individual to plan a time interval of a sunbathing event relative to the individual's tolerance of heat.

Positioned interiorly and spaced below an upper edge of the rear wall 15 is an eye glass case 26, also formed of flexible material, for receiving and securing a pair of sun glasses therewithin. A first flexible securement flap 27 is secured at its side edges to the interior face of the rear wall 15 and positioned adjacent and in contact with the bottom wall 14 to provide a flexible pocket for securement of containers of sun tan lotion and the like therewithin, as illustrated in FIG. 2. A flexible securement and partition flap 28 is secured at one terminal end adjacent a companion terminal end of the first securement flap 27 and is selectively securable at its other end to a third hook and loop fastener strip 29 to provide a convenient first storage orientation of the partition flap 28. A fourth hook and loop fastener strip positioned and secured to an interior face of the forward wall 11 enables the partition flap 28 to be removed from the third fastener strip 29 and secured to the fourth fastener strip 30 to create a partition compartment within the storage bag 10. Due to the inherent flexibility of the flaps 27 and 28 during their non-use, they may be compressed against the interior face of the rear wall 15 to enable the utilization of the complete volume of the storage bag 10, as opposed to the utilization of a rigid pocket organization. Further as the eye glass case 26 is also formed of flexible material, it, too, may be compressed against the interior face of the rear wall 15 to utilize the interior of the storage bag 10 to contain large and bulky items such as towels and the like.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A storage bag comprising, in combination, a rectangular compartment defined by an elongate bottom wall, spaced parallel side walls, a forward wall, and a rear wall, and each of said side walls including a single flexible strap handle mounted to each respective side wall, said rear wall including a plurality of spaced flexible straps secured at their first ends to an exterior surface of the rear wall at a lower edge of the rear wall, and a first fastener patch secured adjacent each second end of each flexible strap selectively engageable with a second fastener patch secured to the exterior surface of the rear wall aligned with and overlying each of the first ends of the flexible straps, and a covering wall including a first hinge means formed between a rear edge of the covering wall and a top edge of the real wall for hingedly maintaining the covering wall to the rear wall, and a flap including a further hinge means for hingedly mounting the flap to a forward edge of the covering wall and a first hook and loop fastener strip secured adjacent a lower edge of the flap engageable with a second hook and loop fastener strip secured to an exterior surface of the forward wall spaced below a top edge of the forward wall, and wherein the side walls, forward wall, rear wall, bottom wall, covering wall, and covering flap are each formed of a flexible material, and including a flexible temperature indicating strip secured to the exterior surface of the forward wall spaced between the second hook and loop fastener strip and the top edge of the forward wall.

2. A storage bag as set forth in claim 1 further including a sun glass formed of flexible material fixedly secured to an interior surface of the rear wall.

3. A storage bag as set forth in claim 2 further including an elongate securement flap secured adjacent the bottom wall with each of its side edges secured to the interior surface of the rear wall.

4. A storage bag as set forth in claim 3 further including a flexible securement and partition flap secured at one elongate edge adjacent one of said side edges of the securement flap with a spaced other edge of the securement and partition flap selectively securable adjacent the other side edge of the securement flap.

5. A storage bag as set forth in claim 4 wherein the other edge of the securement and partition flap is selectively securable to a third hook and loop fastener strip positioned adjacent the other side edge of the flexible securement strap.

6. A storage bag as set forth in claim 5 further including a fourth hook and loop fastener strip formed to an interior surface of the forward wall for selectively receiving the other edge of the securement and partition flap to selectively form a partitioned compartment within the storage bag.

* * * * *